United States Patent [19]

Fukaya et al.

[11] Patent Number: 4,463,724

[45] Date of Patent: Aug. 7, 1984

[54] METHOD FOR CONTROLLING THE AIR-FUEL RATIO IN A CARBURETOR OF AN INTERNAL COMBUSTION ENGINE

[75] Inventors: Kastuyoshi Fukaya, Obu; Akira Tokuda, Nagoya; Hitoshi Hirano, Obu, all of Japan

[73] Assignee: Aisan Kogyo Kabushiki Kaisha, Aichi, Japan

[21] Appl. No.: 366,989

[22] Filed: Apr. 9, 1982

[30] Foreign Application Priority Data

May 30, 1981 [JP] Japan ..... 56-082617
Jun. 24, 1981 [JP] Japan ..... 56-098595

[51] Int. Cl.[3] ..... F02M 7/20
[52] U.S. Cl. ..... 123/438
[58] Field of Search ..... 123/438, 439, 440, 585, 123/589

[56] References Cited

U.S. PATENT DOCUMENTS 4,036,186 7/1977 Hattori et al. ..... 123/438 X
4,077,207 3/1978 Hattori et al. ..... 123/589 X
4,085,716 4/1978 Minami ..... 123/440
4,114,372 9/1978 Ikeuna ..... 123/440 X

*Primary Examiner*—Tony M. Argenbright
*Attorney, Agent, or Firm*—Dennison, Meserole, Pollack & Scheiner

[57] ABSTRACT

A method for controlling the air-fuel ratio in a carburetor which prevents fuel from flowing into an air bleed passage at nearly fully closed position of the tapered needle valve fitted with the air bleed passage by controlling the step motor connected to the needle valve so as to maintain the minimum amount of bleed air at a constant level. In another aspect, at nearly fully closed position of the needle valve, this invention is effective to prevent fuel from flowing into the air bleed passage by continously driving the step motor in a direction of its fully closed position to axially vibrate the needle valve so that the minimum amount of bleed air may be maintained at a constant level. In a further aspect, at nearly fully closed position of the needle valve, this invention is effective to determine the relation between the amount of stroke of the needle valve and the amount of bleed air to flat characteristics by continuously driving the step motor in a direction of the fully closed position of the needle valve so that the minimum amount of bleed air may be maintained at such a level that the fuel is prevented from flowing into the air bleed passage.

5 Claims, 9 Drawing Figures

METHOD FOR CONTROLLING THE AIR-FUEL RATIO OF A CARBURETOR IN AN INTERNAL COMBUSTION ENGINE

BACKGROUND OF THE INVENTION

The present invention relates to a method for controlling the air-fuel ratio in a carburetor of an internal combustion engine.

Traditionally, an air-fuel ratio in a carburetor is controlled by a needle valve driven by an actuator and adapted for changing the amount of air bled into the carburetor. When the amount of air bled into the carburetor is cut off by fully closing the needle valve, the fuel in a fuel passage in the carburetor tends to stick to the inner wall of an air bleed passage or flow into the air bleed passage because of columnar vibration and pulsating flow created in the fuel passage of the carburetor. Under these circumstances, when a control signal enters the actuator to initiate the control operation of the amount of bleed air, the fuel sticking to the inside wall of the air bleed passage or flowing into the air bleed passage is supplied to an engine together with the bleed air, with the result that the ratio of fuel to air (which is hereinafter referred to as the air-fuel ratio) of the supplied fuel mixture is temporarily enriched and the control responsiveness of the air-fuel ratio is reduced, so that the control characteristics of the air-fuel ratio becomes unstable. Moreover, because the needle valve tends to axially vibrate in fully closing operation thereof, the air-fuel ratio may not be maintained at a constant level in fully closing operation and thereby the control characteristics of the air-fuel ratio becomes disadvantageously unstable.

SUMMARY OF THE INVENTION

Accordingly, it is one object of the present invention to provide a method for controlling the air-fuel ratio in a carburetor which is simple and may easily stabilize and improve the control characteristics of the air-fuel ratio at opening and closing operations of the needle valve in the carburetor.

It is another object of the present invention to provide a method for controlling the air-fuel ratio in a carburetor which is simple such that the needle valve is remained in the state of axial vibration for permitting a slight amount of bleed air to enter the fuel passage at fully closed position and may easily stabilize and improve the control characteristics of the air-fuel ratio.

It is a further object of the present invention to provide a method for controlling the air-fuel ratio in a carburetor which may maintain the minimum amount of bleed air at a constant level even when the amount of axial vibration of the needle valve is varied at fully closed position.

According to the present invention, at nearly fully closed position of the tapered needle valve fitted with an air bleed passage, fuel is prevented from flowing into the air bleed passage by controlling the step motor connected to the needle valve so as to maintain the minimum amount of bleed air at a constant level.

In another feature of the present invention, at nearly fully closed position of the tapered needle valve, fuel is prevented from flowing into the air bleed passage by continuously driving the step motor in a direction of its fully closed position to axially vibrate the needle valve, so that the minimum amount of bleed air may be maintained at a constant level.

In a further feature of the present invention, at nearly fully closed position of the tapered needle valve, the relation between the amount of stoke of the needle valve and the amount of bleed air may be determined to flat characteristics by continuously driving the step motor in a direction of the fully closed position of the needle valve, so that the minimum amount of bleed air may be maintained at such a level that the fuel is prevented from flowing into the air bleed passage.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
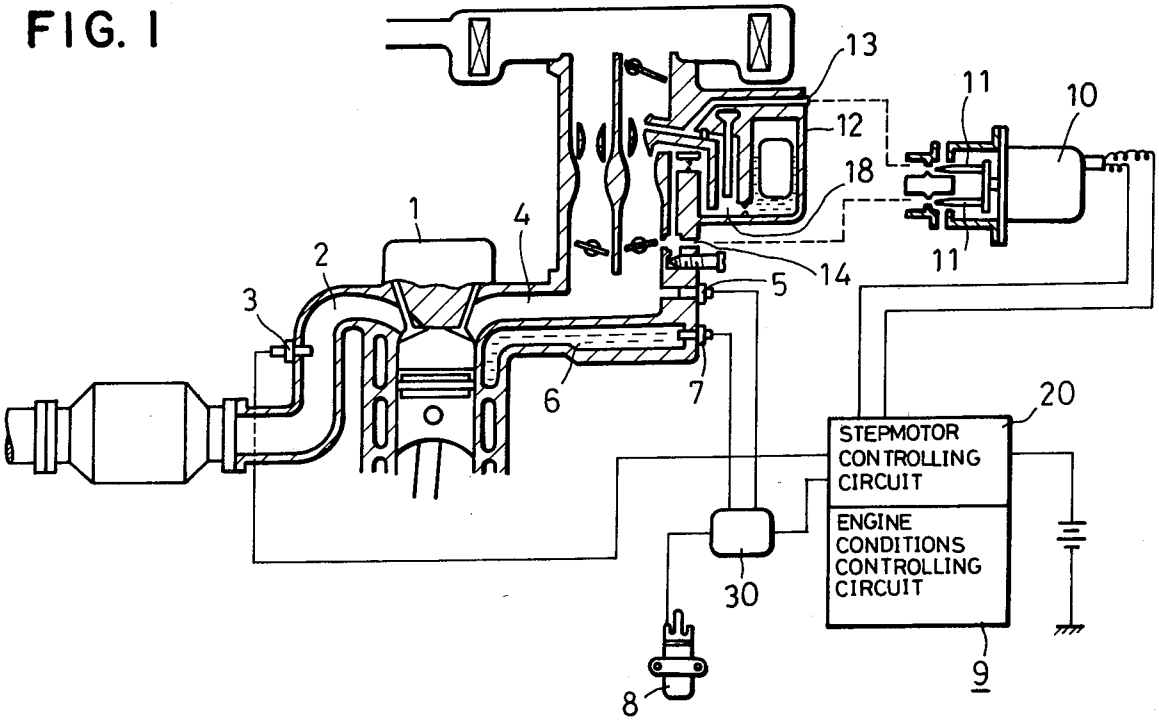
FIG. 1 is an illustrative view of the preferred embodiments in accordance with the present invention.
Figure 2:
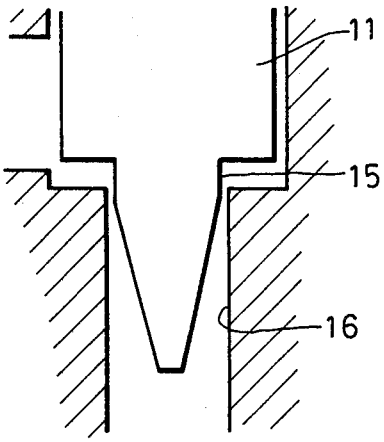
FIG. 2 is an enlarged cross-sectional view of the essential part shown in FIG. 1.
Figure 3:
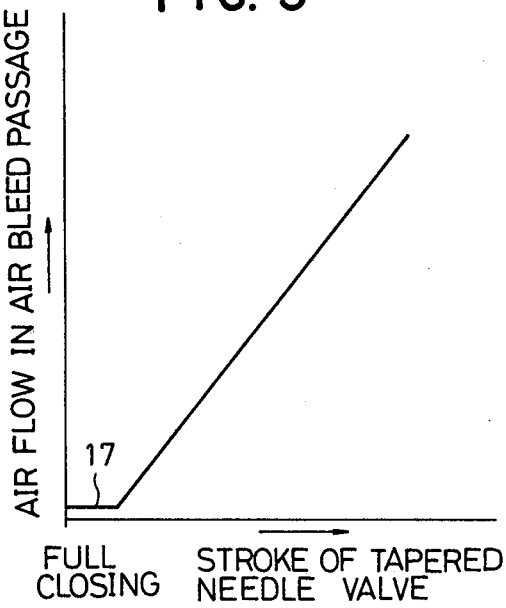
FIG. 3 shows the characteristics in relation with FIG. 2.

Referring now to the drawings, wherein like reference numerals designate identical, or corresponding parts throughout the several views, and more particularly to FIGS. 1 through 3 thereof, an oxygen sensor 3 is provided in an exhaust manifold 2 of an engine 1, and a vacuum sensor 5 is provided in an intake manifold 4. Similarly, an engine cooling water temperature sensor 7 is provided in a water jacket 6 of the engine 1 and an ignition coil 8 is provided as for detecting engine speeds. Each sensor is connected to an engine conditions controlling circuit 9 and signals from the sensors are transmitted to the control circuit 9. A step motor 10 is so controlled as to rotate in a forward and reverse directions in response to outputs from the control circuit 9. The step motor 10 is provided with a tapered needle valve 11 and is so designed as to reciprocate the needle valve 11 in the axial direction by the forward and reverse rotations thereof, thereby varying the opening areas of an air bleed passage 13 for main fuel system and an air bleed passage 14 for slow system of a carburetor 12. The tapered needle valve 11 is designed to be cylindrical at its base portion 15. At the position shown in FIG. 2, the relation between the amount of bleed air and the stroke of the tapered needle valve 11 is illustrated in FIG. 3. It should be noted that under the substantially fully closed conditions of the needle valve 11, there is indicated flat characteristics 17 as shown in FIG. 3. That is, under these conditions the tapered needle valve 11 serves to prevent the fuel in a fuel passage 18 from flowing into the air bleed passages 13 and 14 and at the same time, maintain the minimum amount of bleed air at a constant level, thereby rendering fuel to air mixing to be in substantially equal condition to the fully closed position.

Figure 4:
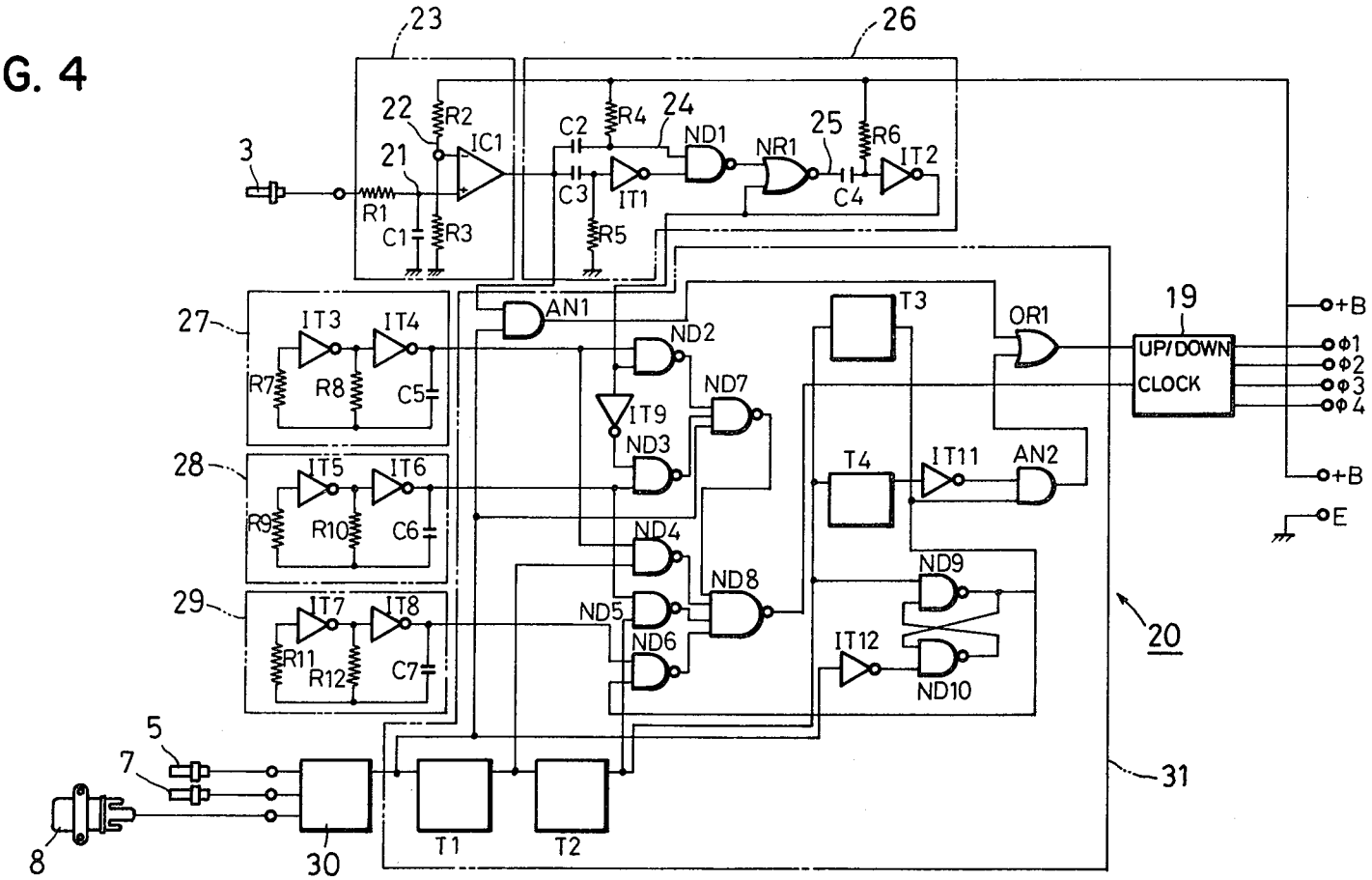
FIG. 4 is a circuit diagram of the first preferred embodiment.

Referring next to FIG. 4 which diagrammatically illustrates an air-fuel ratio control circuit 20 for controlling outputs from a distributing excitation circuit 19 of the step motor 10, the oxygen sensor 3 is connected through CR filter 21 to non-inverting input terminal of an operational amplifier IC1, and a reference voltage setting circuit 22 is connected to inverting input terminal of the operational amplifier IC1. A richness/leanness determining circuit 23 is adapted to compare the voltage corresponding to the oxygen concentration signal transmitted from the oxygen sensor 3 with the reference voltage of the circuit 22. A skip time setting circuit 26 is adapted to generate outputs from a monostable multivibrator 25 during a given period of time, for example, 0.1 seconds which is determined by the pulse width of the pulse outputted from the multivibrator 25 upon generation of a trigger pulse from a trigger pulse generating circuit 24. Clock oscillators 27, 28 and 29 are adapted for generating high-, standard- and low-frequency clock pulses, respectively. An engine conditions detecting circuit 30 is adapted to generate outputs respective to engine conditions, after receiving signals transmitted from the sensors. A switching circuit 31 is adapted to switch the electrical connection between the clock terminal of the distributing excitation circuit 19 and the output terminals of the clock oscillators 27, 28 and 29, depending upon the conditions of the outputs from the skip time setting circuit 26 and the timers T1, T2 and T3, and at the same time, adapted to switch the electrical connection to up/down input terminal of the circuit 19, depending upon the conditions of the outputs from the richness/leanness determining circuit 23 and timer T4.

In FIG. 4, symbols C, R, AN, OR, ND, NR, IT, +B, E and $\phi 1$–$\phi 4$ represent capacitor, resistor, AND circuit, OR circuit, NAND circuit, NOR circuit, inverter circuit, positive power supply, ground and phase terminals of the circuit 19, respectively. Reference numerals affixed after identical symbols designate identical elements. The set time of the timer T4 is preset to shorter than that of the timer T3.

Figure 5:
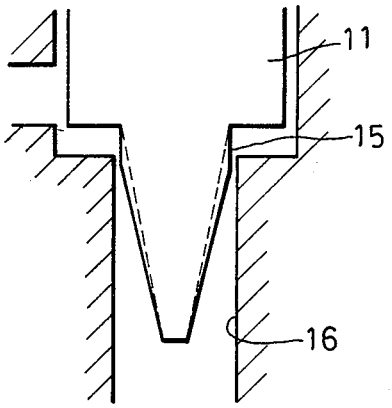
FIG. 5 is an enlarged cross-sectional view of the essential part, which is similar to FIG. 2, of the second preferred embodiment.
Figure 6:
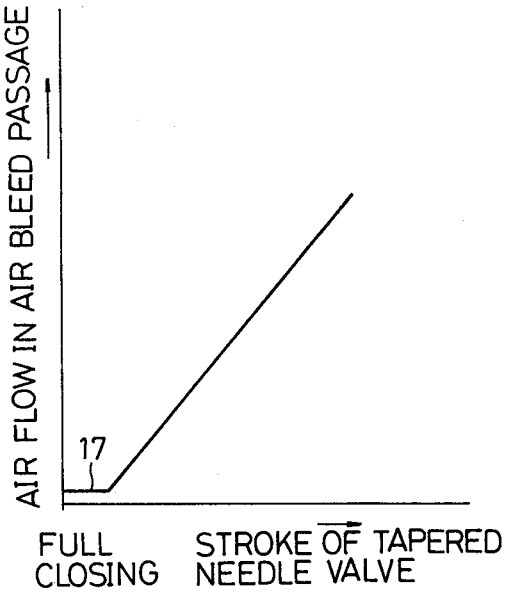
FIGS. 6 through 8 show the characteristics in relation with FIG. 5.
Figure 7:
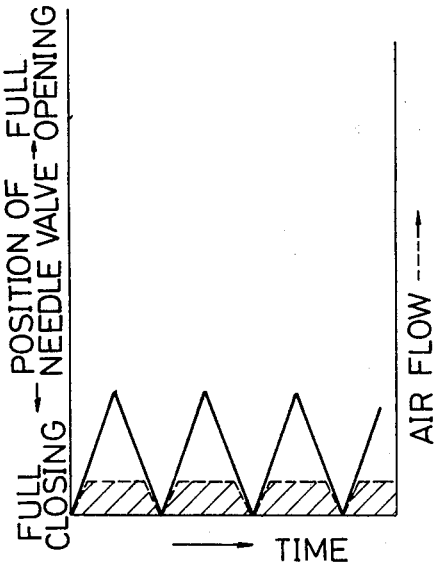
Figure 8:
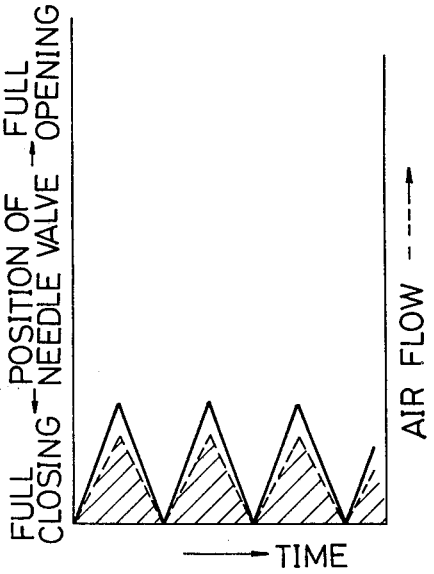

Referring to FIGS. 5 through 8 illustrating the second embodiment of the invention, when the tapered needle valve 11 is continuously vibrated in its axial direction at the substantially fully closed position shown in FIG. 5, it serves to prevent the fuel from flowing into the air bleed passages 13 and 14 and at the same time, maintain the minimum amount of bleed air at a constant level as illustrated by the shade in FIG. 7. In the case that the tapered needle valve 11 is of the shape illustrated by the dotted line in FIG. 5, the minimum amount of bleed air at the fully closed position can be maintained at a desired level in accordance with the amount of the axial vibration of the needle valve 11 as illustrated by the shade in FIG. 8.

Figure 9:
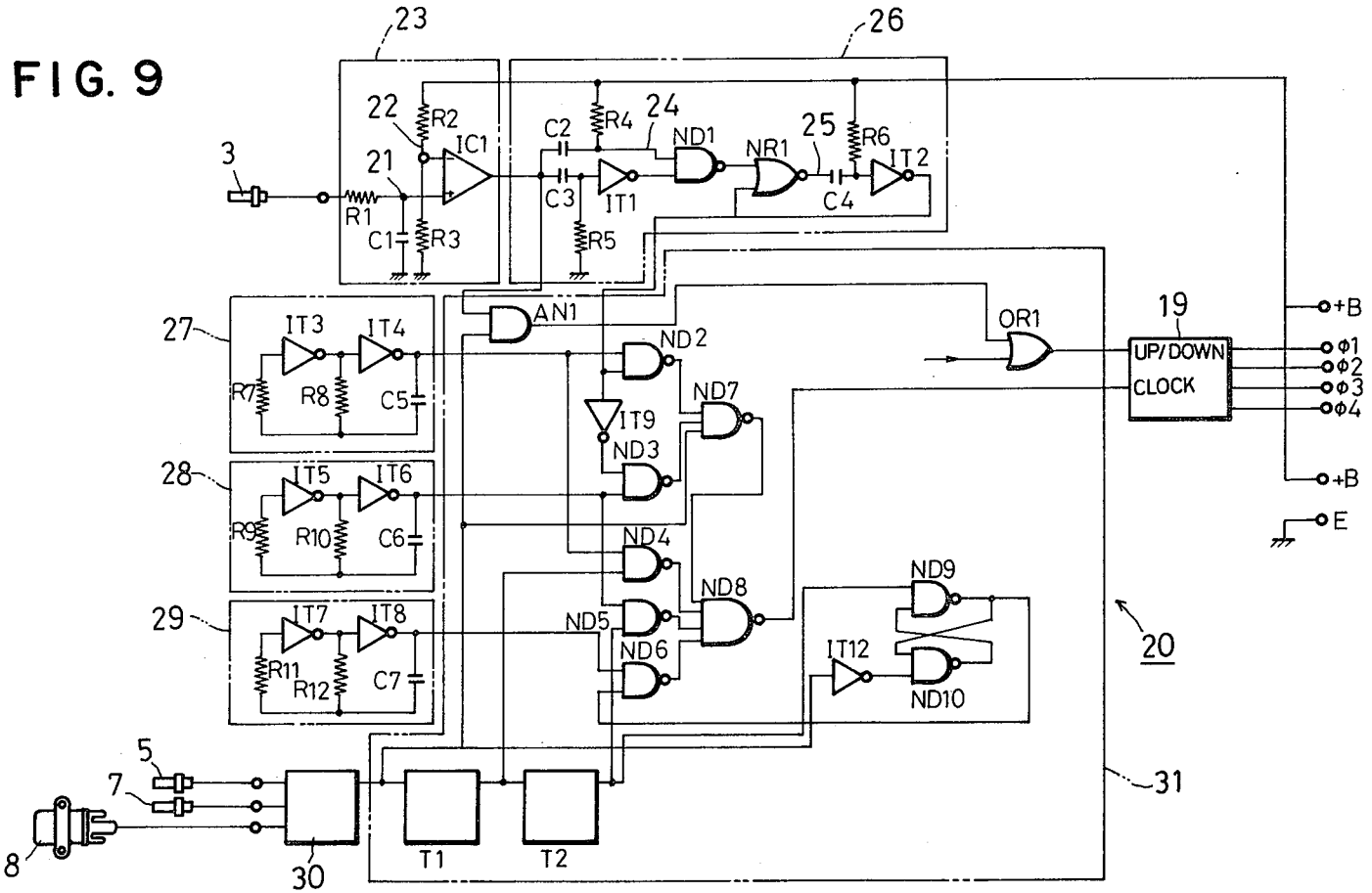
FIG. 9 is a circuit diagram of the second preferred embodiment.

FIG. 9 shows an air-fuel ratio control circuit of the second preferred embodiment. The constitution of the control circuit 20 is substantially identical with that shown in FIG. 4 except that a switching circuit 31 is adapted to switch the electrical connection between the clock terminal of the distributing excitation circuit 19 and the output terminals of the clock oscillators 27, 28 and 29, depending upon the conditions of the outputs from the skip time setting circuit 26 and the timers T1 and T2, and at the same time, adapted to switch the electrical connection to up/down input terminal of the circuit 19, depending upon the conditions of the outputs from the richness/leanness determining circuit 23 and the engine conditions detecting circuit 30.

In operation of the first preferred embodiment, when an air-fuel ratio is controlled to a stoichiometric air-fuel ratio, output from the engine conditions detecting circuit 30 is preset to "H" and outputs from the timers T1, T2, T3 and T4 are preset to "L". As the result, the switching circuit 31 performs a switching operation only depending upon the outputs from the richness/leanness determining circuit 23 and the skip time setting circuit 26. When an air-fuel ratio is increased and decreased in comparison to the stoichiometric ratio, the outputs from the richness/leanness determining circuit 23 are changed, thereby causing the electrical connection to the up/down input terminal of the distributing excitation circuit 19 to be switched. In every switching operation, a high frequency clock pulse from the clock oscillator 27 is inputted to the clock terminal of the circuit 19 during a given period of time corresponding to the width of the pulse from the circuit 26, and thereafter a standard frequency clock pulse from the clock oscillator 28 is inputted to the clock terminal of the circuit 19, thereby rendering the step motor 10 to rotate with a high responsiveness in such a direction as the air-fuel ratio is returned to the stoichiometric ratio.

In the case that an air-fuel ratio should be controlled to a richer ratio than the stoichiometric ratio, dependent upon engine conditions such as engine speeds, intake manifold vacuum and engine coolant temperature, output from the engine conditions detecting circuit 30 is inversed and thereby output from AND circuit AN2 via flip-flop circuit constituted of NAND circuits ND9 and ND10 is also inversed. As the result, input for enriching the air-fuel ratio enters the up/down input terminal of the circuit 19. At the same time, output from the timer T1 is inversed and a high frequency clock pulse from the clock oscillator 27 is inputted to the clock terminal of the circuit 19 during a given period of time set by the timer T1. At the next time, output from the timer T2 is inversed and a standard frequency clock pulse from the clock oscillator 28 is inputted to the clock terminal of the circuit 19 during a given period of time set by the timer T2. At the further next time, output from the timer T3 is inversed and a low frequency clock pulse from the clock oscillator 29 is inputted to the clock terminal of the circuit 19 during a given period of time set by the timer T3. As the result, the step motor 10 is so rotated as to progressively lower its speed, thereby causing the needle valve 11 to be in a fully closed position without occurrence of the axial vibration thereof. The timer T4, the setting time of which is preset to shorter than that of the timer T3, is operated at the same time the timer T3 is operated. On the lapse of the setting time of the timer T4, the input to the up/down terminal of the circuit 19 is inversed, and during the rest of the setting time of the timer T3, the step motor 10 is so rotated as to open the needle valve 11, thereafter terminating the rotation. Under these circumstances, the needle valve 11 is positioned as illustrated in FIG. 2 which corresponds to the flat characteristics 17 as shown in FIG. 3, that is, the needle valve 11 is in substantially fully closed position, thereby permitting the minimum amount of bleed air to be maintained at a constant level and preventing the fuel from flowing into the air bleed passages 13 and 14.

As should be apparent from the above description, air flows in the air bleed passages 13 and 14 at all times, thereby obtaining greatly improved responsiveness of air-fuel ratio from "richness" to "leanness". Furthermore, because the diameter of the needle valve 11 is constant at its base portion in a given length thereof, a constant air-fuel ratio is obtained even when the needle valve 11 stops at any position in the given length, which is effective particularly at idle operation. In fully closing operation of the needle valve 11, the amount of axial vibration of the needle valve 11 at fully closed position can be reduced by progressively lowering the driving speed of the step motor 10 and at nearly fully closed position, by remarkably lowering the speed of the step motor 10. When the step motor 10 is reversely rotated by several steps from the fully closed position of the needle valve 11 and then terminates the rotation, the scattering of the opening degree of the needle valve 11 may be diminished.

Even when the timer T2 and the clock oscillator 29 are omitted from the air-fuel ratio control circuit 20 for purposes of the simplicity of the circuit, substantially same effect can be obtained except that the amount of axial vibration of the needle valve 11 is slightly increased at fully closed position. Besides, even when the base portion 15 of the needle valve 11 is not cylindrically formed, substantially same effect can be obtained except that the performance is slightly decreased.

The operation of the second preferred embodiment is substantially identical with that of the first embodiment in the case that an air-fuel ratio is controlled to the stoichiometric ratio, and therefore the explanation of the operation will be omitted.

In the case that an air-fuel ratio should be controlled to a richer ratio than the stoichiometric ratio dependent upon engine conditions such as engine speeds, intake manifold vacuum and engine coolant temperature, a signal for enriching the air-fuel ratio is inputted into the up/down terminal of the circuit 19 via OR circuit OR1. At the same time, output from the timer T1 is inversed and a high frequency clock pulse from the clock oscillator 27 is inputted to the clock terminal of the circuit 19 during a given period of time set by the timer T1. At the next time, output from the timer T2 is inversed and a standard frequency clock pulse from the clock oscillator 28 is inputted to the clock terminal of the circuit 19 during a given period of time set by the timer T2. At the further next time, output from the flip-flop circuit constituted of NAND circuits ND9 and ND10 is inversed and a low frequency clock pulse from the clock oscillator 29 is inputted to the clock terminal of the circuit 19. As the result, the step motor 10 is so rotated as to progressively lower its speed, thereby causing the needle valve 11 to be in a fully closed position.

It should be apparent from the foregoing description that when an air-fuel ratio should be controlled to the stoichiometric ratio, the needle valve 11 is remained in the fully closed position under the condition where the step motor 10 is driven by a standard clock pulse from the clock oscillator 28, while when an air-fuel ratio is controlled to a richer ratio than the stoichiometric ratio, the needle valve 11 is remained in the fully closed position under the condition where the step motor 10 is driven by a low frequency clock pulse from the clock oscillator 29. As the result, the needle valve 11 as illustrated by a solid line and illustrated by a dotted line in FIG. 5 is axially vibrated by three to ten steps, assuming that one step is defined as a unit angle of rotation of the step motor, in the case that the frequency for driving the step motor 10 is in the range of 1–180 pps (pulse per second) as respectively shown in FIGS. 7 and 8, thereby causing a minimum amount of bleed air to be maintained at a constant level under the substantially fully closed condition and preventing the fuel from flowing into the air bleed passages 13 and 14.

Other effects and advantages of the second preferred embodiment is substantially identical with those of the first embodiment, and therefore the explanation regarding the matter will be omitted.

Although some preferred embodiments of the invention have been disclosed and described, it is apparent that other embodiments and modifications of the invention are possible within the scope of the appended claims.

What is claimed is:

1. A method of controlling an air-fuel ratio in a carburetor of an internal combustion engine, said carburetor having a fuel passage and an air bleed passage, said air bleed passage communicating with said fuel passage at its one end and having a tapered needle valve at its other end for controlling the amount of bleed air, said tapered needle valve being formed with a cylindrical portion at its base and being driven by a step motor, said method comprising the step of controlling said step motor so as to maintain at a constant level the minimum amount of bleed air in a substantially fully closed position of said needle valve and to prevent the fuel from flowing through said fuel passage into said air bleed passage.

2. The method as defined in claim 1, further comprising the step of varying a driving speed of said step motor progressively from high speeds to low speeds when said needle valve moves in a direction of its fully closed position.

3. The method as defined in claim 1, further comprising the step of determining the relation between the amount of stroke of said needle valve and the amount of bleed air in such a manner that the minimum amount of bleed air is maintained at a constant level.

4. A method of controlling an air-fuel ratio in a carburetor of an internal combustion engine, said carburetor having a fuel passage and an air bleed passage, said air bleed passage communicating with said fuel passage at its one end and having a tapered needle valve at its other end for controlling the amount of bleed air, said tapered needle valve being formed with a cylindrical portion at its base and being driven by a step motor, said method comprising the steps of driving said step motor so as to bounce a base surface of said needle valve on an end surface of a valve hole opposite to said base surface to a predetermined distance therebetween, and supplying bleed air into said valve hole intermittently with the minimum amount of bleed air maintained at a constant level.

5. A method of controlling an air-fuel ratio in a carburetor of an internal combustion engine, said carburetor having a fuel passage and an air bleed passage, said air bleed passage communicating with said fuel passage at its one end and having a tapered needle valve at its other end for controlling the amount of bleed air, said tapered needle valve being formed with a cylindrical portion at its base and being driven by a step motor, said method comprising the step of determining the relation between the amount of stroke of said needle valve and the amount of bleed air to such a characteristic that a constant amount of bleed air is intermittently supplied into a valve hole at a predetermined cycle by driving said step motor so as to bounce a base surface of said needle valve on an end surface of said valve hole opposite to said base surface to a predetermined distance therebetween.

* * * * *